US008328539B2

(12) United States Patent
Watson et al.

(10) Patent No.: US 8,328,539 B2
(45) Date of Patent: Dec. 11, 2012

(54) SUBMERSIBLE PUMP MOTOR PROTECTOR

(75) Inventors: Arthur I. Watson, Sugar Land, TX (US); Christopher E. Featherby, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 239 days.

(21) Appl. No.: 12/648,718

(22) Filed: Dec. 29, 2009

(65) Prior Publication Data

US 2010/0172773 A1 Jul. 8, 2010

Related U.S. Application Data

(60) Provisional application No. 61/141,487, filed on Dec. 30, 2008.

(51) Int. Cl.

| | |
|---|---|
| ***F04B 17/03*** | (2006.01) |
| ***F04B 19/00*** | (2006.01) |
| ***H02K 5/132*** | (2006.01) |
| ***H02K 5/22*** | (2006.01) |

(52) U.S. Cl. ..... 417/423.3; 417/414; 310/87; 166/68; 166/105.3; 166/109; 166/110

(58) Field of Classification Search ..... 417/414, 417/423.3; 166/68, 105.3, 109, 110, 167, 166/169; 310/87

See application file for complete search history.

(56) References Cited

U.S. PATENT DOCUMENTS

| | | | | |
|---|---|---|---|---|
| 2,715,687 | A | 8/1955 | Makous | |
| 3,475,634 | A | 10/1969 | Bogdanov et al. | |
| 3,947,709 | A * | 3/1976 | Waltman | 310/87 |
| 4,633,970 | A | 1/1987 | Mifsud | |
| 6,059,539 | A * | 5/2000 | Nyilas et al. | 417/228 |
| 6,242,829 | B1 | 6/2001 | Scarsdale | |
| 6,688,860 | B2 | 2/2004 | Du et al. | |
| 6,981,853 | B2 | 1/2006 | Du et al. | |
| 7,217,107 | B2 | 5/2007 | Du et al. | |
| 2005/0167096 | A1 * | 8/2005 | Du et al. | 166/105 |
| 2007/0059166 | A1 * | 3/2007 | Sheth et al. | 415/199.1 |
| 2007/0224056 | A1 * | 9/2007 | Watson et al. | 417/414 |
| 2008/0004599 | A1 * | 1/2008 | Simpson et al. | 604/523 |

* cited by examiner

*Primary Examiner* — Devon Kramer
*Assistant Examiner* — Dominick L Plakkoottam
(74) *Attorney, Agent, or Firm* — Jim Patterson

(57) ABSTRACT

According to one or more aspects of the present disclosure, a motor protector comprises a housing defining a compensator chamber; a compensator disposed in the housing having a motor fluid end in fluid communication with a motor fluid and a well fluid end, the compensator axially moveable relative to the housing in response to the expansion and contraction of the motor fluid; and a port formed through the housing to provide fluid communication from exterior of the housing to the well fluid end of the compensator. The compensator may be one selected from the group of a bellows and a plunger.

13 Claims, 5 Drawing Sheets

SUBMERSIBLE PUMP MOTOR PROTECTOR

RELATED APPLICATIONS

This application claims the benefit of U.S. Provisional Patent Application No. 61/141,487 filed on Dec. 30, 2008.

BACKGROUND

This section provides background information to facilitate a better understanding of the various aspects of the present invention. It should be understood that the statements in this section of this document are to be read in this light, and not as admissions of prior art.

A variety of production fluids are pumped from subterranean environments. Different types of submersible pumping systems may be disposed in production fluid deposits at subterranean locations to pump the desired fluids to the surface of the earth.

For example, in producing petroleum and other useful fluids from production wells, it is generally known to provide a submersible pumping system for raising the fluids collected in a well. Production fluids, e.g. petroleum, enter a wellbore drilled adjacent a production formation. Fluids contained in the formation collect in the wellbore and are raised by the submersible pumping system to a collection point at or above the surface of the earth.

A typical submersible pumping system comprises several components, such as a submersible electric motor that supplies energy to a submersible pump. The system further may comprise a variety of additional components, such as a connector used to connect the submersible pumping system to a deployment system. Conventional deployment systems include production tubing, cable and coiled tubing. Additionally, power is supplied to the submersible electric motor via a power cable that runs through or along the deployment system.

Often, the subterranean environment (specifically the well fluid) and fluids that are injected from the surface into the wellbore (such as acid treatments) contain corrosive compounds that may include carbon dioxide, hydrogen sulfide and brine water. These corrosive agents can be detrimental to components of the submersible pumping system, particularly to internal electric motor components, such as copper windings and bronze bearings. Moreover, irrespective of whether or not the fluid is corrosive, if the fluid enters the motor and mixes with the motor oil, the fluid can degrade the dielectric properties of the motor oil and the insulating materials of the motor components. Accordingly, it is highly desirable to keep these external fluids out of the internal motor fluid and components of the motor.

Submersible electric motors are difficult to protect from corrosive agents and external fluids because of their design requirements that allow use in the subterranean environment. A typical submersible motor is internally filled with a fluid, such as a dielectric oil, that facilitates cooling and lubrication of the motor during operation. As the motor operates, however, heat is generated, which, in turn, heats the internal motor fluid causing expansion of the oil. Conversely, the motor cools and the motor fluid contracts when the submersible pumping system is not being used.

In many applications, submersible electric motors are subject to considerable temperature variations due to the subterranean environment, injected fluids, and other internal and external factors. These temperature variations may cause undesirable fluid expansion and contraction and damage to the motor components. For example, the high temperatures common to subterranean environments may cause the motor fluid to expand excessively and cause leakage and other mechanical damage to the motor components. These high temperatures also may destroy or weaken the seals, insulating materials, and other components of the submersible pumping system. Similarly, undesirable fluid expansion and motor damage can also result from the injection of high-temperature fluids, such as steam, into the submersible pumping system.

Accordingly, this type of submersible motor benefits from a motor fluid expansion system able to accommodate the expanding and contracting motor fluid. The internal pressure of the motor must be allowed to equalize or at least substantially equalize with the surrounding pressure found within the wellbore. As a result, it becomes difficult to prevent the ingress of external fluids into the motor fluid and internal motor components.

Three primary types of motor protectors have been designed and used in isolating submersible motors while permitting expansion and contraction of the internal motor fluid. The three types of motor protectors may be utilized singularly and in combination. A first type is a labyrinth type protector that uses the differences in the specific gravity of the well fluid and the motor fluid (e.g., oil) to separate the fluids. For example, a typical labyrinth may embody a chamber having a first passageway to the motor fluid and a second passageway to an undesirable fluid, such as the fluid in the wellbore. The first and second passageways are generally oriented on opposite sides of the chamber to maintain fluid separation in a vertical orientation.

A second type is a piston type protector that moves axially in relation to the other components to adjust to a changing volume of the motor fluid. A third type is a bellows or bag type protector, wherein the bellow or bag may be formed of metal or an elastomeric material. The bellows type protectors provide two important functions: equalizing the fluid pressure within the motor and preventing well fluids (e.g., liquids and gases) from contaminating the motor fluid.

In various well applications, solids accumulate on the well fluid side of the compensating element (e.g., bellows, piston), which in time physically inhibits movement of the compensating element thereby restricting expansion of the motor oil. When the pump is turned off, the motor oil and compensator retract drawing well fluid into the protector. The well fluid, having been turbulent, can carry a high concentration of suspended solids. While the pump is inactive, the solids settle out of the well fluid around the compensation element to form a sediment bed. When the pump is started, the well fluid is expelled as the motor oil expands leaving the sediment in the motor protector. Over time this sediment bed may accumulate to a level preventing adequate movement of the compensating element. It is therefore a desire, according to one or more aspects of the present disclosure, to eliminate or to reduce the detrimental effects of solids on the operation of motor protector compensators.

SUMMARY

According to one or more aspects of the present disclosure, a motor protector comprises a housing defining a compensator chamber; a compensator disposed in the housing having a motor fluid end in fluid communication with a motor fluid and a well fluid end, the compensator axially moveable relative to the housing in response to the expansion and contraction of the motor fluid; and a port formed through the housing to provide fluid communication from exterior of the housing to the well fluid end of the compensator. The compensator may be one selected from the group of a bellows and a plunger.

According to one or more aspects of the present disclosure, a submersible pump system comprises a pump disposed in a wellbore containing a wellbore fluid; a motor disposed in the wellbore, the motor comprising a motor fluid; and a motor protector disposed in the wellbore, the motor protector comprising a housing defining a compensator chamber; a port formed radially through the housing; and a bellows disposed in the housing, the bellows comprising an interior in fluid communication with the motor fluid and a well fluid end in fluid communication with the wellbore fluid via the port, the bellows axially expandable relative to the housing in response to the expansion and contraction of the motor fluid.

A submersible pump system according to one or more aspects of the present disclosure comprises a pump disposed in a wellbore containing a wellbore fluid; a motor disposed in the wellbore, the motor comprising a motor fluid; and a motor protector disposed in the wellbore, the motor protector comprising: a plurality of axially extending, spaced apart elongate members defining a bellows chamber; and a bellows position in the bellows chamber, the bellows comprising an interior in fluid communication with the motor fluid and a well fluid end in fluid communication with the wellbore fluid through channels between the adjacent spaced apart elongate members.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
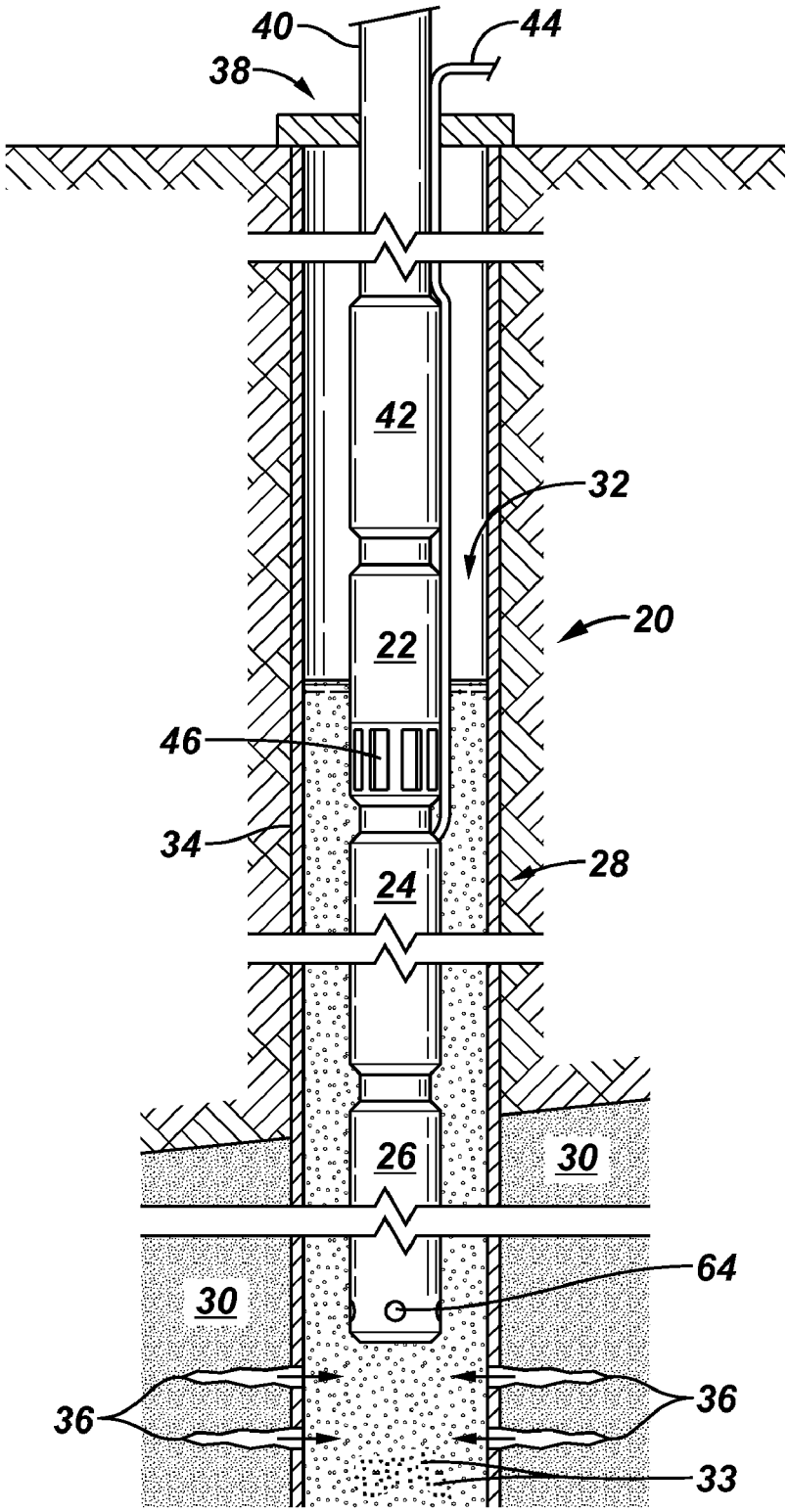
FIG. 1 is a schematic view of a submersible pump system apparatus according to one or more aspects of the present disclosure disposed in a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface.

In this disclosure, "fluidically coupled" or "fluidically connected" and similar terms, may be used to describe bodies that are connected in such a way that fluid pressure (e.g., hydraulic, pneumatic) may be transmitted between and among the connected items. The term "in fluid communication" is used to describe bodies that are connected in such a way that fluid can flow between and among the connected items. It is noted that fluidically coupled may include certain arrangements where fluid may not flow between the items, but the fluid pressure may nonetheless be transmitted. Thus, fluid communication is a subset of fluidically coupled.

FIG. 1 is a schematic of a submersible pumping system 20, depicted in the form of an electric submersible pumping system, according to one or more aspects of the present disclosure. Pumping system 20 comprises a submersible pump 22, a submersible motor 24 and a motor protector 26. In the example provided, pumping system 20 is designed for deployment in a well 28 within a geological formation 30 containing reservoir fluid 31, such as petroleum. In a typical application, a wellbore 32 is drilled and lined with a wellbore casing 34. Wellbore casing 34 may include a plurality of openings 36, e.g. perforations, through which fluid 31 (e.g., production fluid) flows into wellbore 32. Fluid 31 may carry solids 33, depicted as particles (e.g., sand particles).

Pumping system 20 is deployed in wellbore 32 by a deployment system 38 that also may have a variety of forms and configurations. For example, deployment system 38 may comprise tubing 40 connected to submersible pump 22 by a connector 42. Power is provided to submersible motor 24 via a power cable 44. Submersible motor 24, in turn, powers the submersible pump 22 which draws production fluid 31 (e.g., wellbore fluid, reservoir fluid) in through a pump intake 46 and pumps the production fluid to a collection location via, for example, tubing 40. In other configurations, the production fluid may be produced through the annulus formed between deployment system 38 and wellbore casing 34. Motor protector 26 enables the reduction of differential pressure between fluid 31 in wellbore 32 and internal motor fluid within submersible motor 24 and motor protector 26. The motor protector 26 also protects the internal motor fluid from exposure to deleterious elements of the surrounding wellbore fluid. Motor protector 26 is depicted positioned below submersible motor 24, however the motor protector also can be designed for positioning in whole or in part above submersible motor 24.

Figure 2:
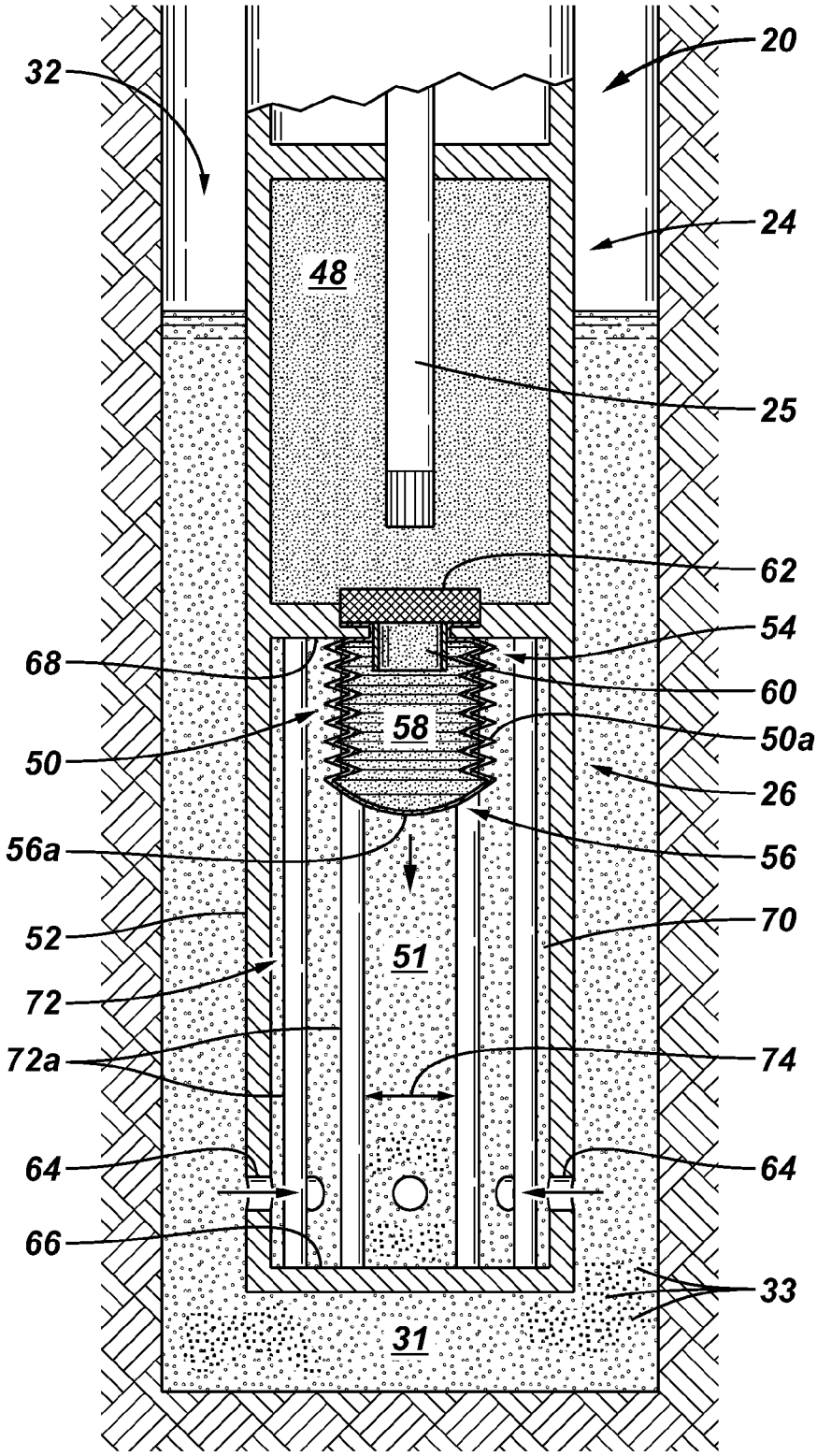
FIG. 2 is an expanded, schematic cut-away view of a motor protector comprising a bellows-type compensator in a contracted position according to one or more aspects of the present disclosure.

FIG. 2 is an expanded sectional schematic of an embodiment of motor protector 26 of an electric submersible pump system 20 according to one or more aspects of the present disclosure. In the depicted embodiment, motor protector 26 is disposed below motor 24. A portion of motor 24 is depicted containing motor fluid 48 (e.g., oil) and disposing a portion of shaft 25.

Motor protector 26 comprises a compensator 50 to provide volume compensation, for example, for the thermal expansion and contraction of motor fluid 48. Compensator 50 depicted in FIGS. 2 and 3 is a bellows type compensator.

Figure 3:
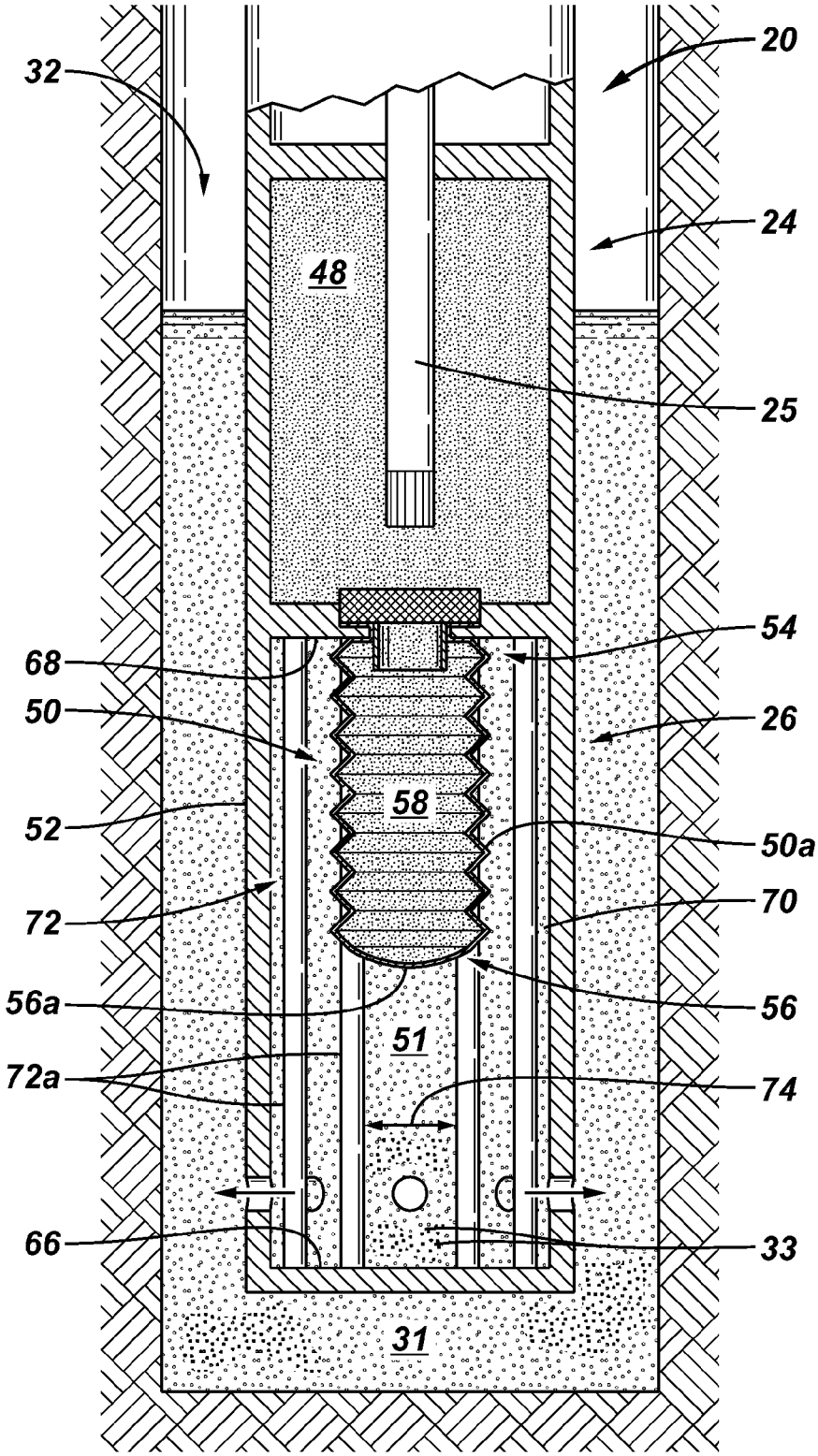
FIG. 3 is an expanded, schematic cut-away view of a motor protector comprising a bellows-type compensator in an expanded position according to one or more aspects of the present disclosure.

Compensator 50 is illustrated in a contracted position in FIG. 2 and in the expanded position in FIG. 3. In the depicted embodiment, compensator 50 is a generally cylindrical member formed of an elastomeric material which may expand and contract axially and/or radially. In some embodiments, compensator 50 may be constructed of metal. Bellows is used in the present disclosure to include metal and elastomeric devices unless expressly stated otherwise. Bellows 50 is a generally cylindrical member having exterior surface 50*a* (e.g., perimeter). Bellows 50 may be accordion like to provide in particular axial expansion and contraction.

Compensator 50 is positioned in a compensator chamber 51 of a compensator housing 52 in the embodiment of FIG. 2. Compensator 50 comprises a well fluid end 54 and a motor fluid end 56. Motor fluid 48 is in fluid communication with the interior 58 of compensator 50 via an opening 60 formed through motor fluid end 56. A filter 62 is positioned proximate to opening 60 in FIG. 2. In the depicted embodiment, motor fluid end 56 is secured in a stationary position relative to compensator housing 52 and motor 24 permitting fluid end 54 to move axially in response to the expansion and contraction of motor fluid 48.

Pump system 20 is disposed in wellbore 32 below the level of fluid 31 in the wellbore. Fluid 31 is in fluid communication with compensator chamber 51 and provides a force (e.g., fluidic pressure) on compensator 50 and thus on motor fluid 48. In the depicted embodiment, at least one port 64 is formed through compensator housing 52. In the depicted embodiment, a plurality of ports 64 are depicted formed proximate to the bottom end 66 of compensator housing 52. Bottom end 66 is axially distal from the stationary point at which motor fluid end 56 of the compensator is secured. In the depicted embodiment, bottom end 66 is axially distal from the top end 68 of compensator housing 52. Compensator chambers and housings commonly do not include equalization ports, instead pressure equalization is provide through a breather hole provide above the compensator housing.

Wellbore fluid 31 comprises suspended solids 33 (e.g., sand particles) which generally have a common particle size or distribution (e.g., range) of sizes. The size or general range of particles 33 present in a particular wellbore or anticipated to be encountered in a wellbore can be determined or estimated. In the depicted embodiment, ports 64 have a diameter sufficiently large to avoid bridging of particles 33 across port(s) 64. Determination of port sizes to prevent bridging for a known size distribution of particles is known in the art. Sand particles 33 that enter housing 52 will tend to be expelled out of ports 64 when compensator 50 expands. According to one or more aspects of the present disclosure, well fluid end 56 of compensator 50 may be externally contoured (e.g., domed) and oriented to urge fluid 31 and solids 33 in chamber 51 toward and out of port(s) 64 when compensator 50 expands. For example, the contoured feature (e.g., dome) of well fluid end 56 has an apex 56*a* directed toward bottom end 66 and ports 64 ahead of the body of compensator 50.

FIGS. 2 and 3 do not illustrate a filter disposed in compensator chamber 51 separating for example the exterior 50*a* of compensator 50 from the inlet (e.g., ports 64 in this embodiment) of well fluid 31. A filter may provide an additional point for bridging of particles, thus detrimentally affecting the operation of compensator 50. One or more aspects of the present disclosure may be utilized to promote free operation of compensator 50 and protect compensator 50 from solids 33.

According to one or more aspects of the present disclosure, a controlled space 70 (e.g., annular space) may be provided between the exterior perimeter 50*a* of the expanded compensator 50 and compensator housing 52. Controlled space 70 is used generally herein to define a space, in particular an annular space, about the circumference (e.g., exterior surface 50*a*) of bellows-type compensator 50 that is free of encroachment by compensator 50 when the bellows is expanded (FIG. 2) to provide a type of protective buffer to compensator 50. The controlled annular space may be provided, for example, to prevent damage to compensator 50 from bridging solids 33. The controlled annular space may reduce the occurrence or likelihood that full, and free, expansion and/or contraction of compensator 50 will be limited for example due to accumulation (e.g., bridging) of sand particles 33. For example, sand particles 33 may be the same size or smaller than the diameter of ports 64 to enter into chamber 51. The sand particles may lodge, for example, between a port 64 and/or housing 52 and the exterior 50*a* of compensator 50. This lodging may cause compensator 50 to be jammed into housing 52 or otherwise prevent compensator 50 from freely expanding or contracting. According to one or more aspects of the present disclosure, controlled space 70 may be at least equal to the diameter of port(s) 64 so as to avoid bridging of solids 33. In some embodiments, controlled space 70 is equal to two or more diameters of ports 64 to further reduce the ability of solids 33 to bridge from housing 52, in particular ports 64, to bellows 50.

In some embodiments, the dimensions of compensator 50 are selected such that the distance between exterior surface 50*a* of expanded compensator 50 and compensator housing 52 provides the desired controlled annular space 70. In other words, the bellows does not expand radially into the controlled annular space 70. In the depicted embodiment of FIGS. 2 and 3, the controlled space 70 may be established by a device such as frame 72 which is described below. It is noted that FIGS. 2 and 3 depict several aspects according to the present disclosure that may be used singularly or in combination as depicted in FIGS. 2 and 3.

According to one or more aspects of the present disclosure, a frame 72 may be provided to maintain compensator centered and/or spaced away from housing 52 (as depicted in FIGS. 2 and 3). Bellows type compensators tend to be supple and the middle portion of the compensator in particular can contact or move toward the walls of housing 52. Contacting the walls and or approaching the walls of housing 52 may result in damage to the compensator and/or result in jamming of the compensator thus preventing full and free expansion and/or contraction. In the depicted embodiment, frame 72 comprises a plurality of spaced apart elongate, axially extending members 72*a* (e.g., rods) positioned to maintain compensator 50 substantially centered relative to compensator housing 52. In this embodiment, elongate members 72*a* extend axially from top end 68 to bottom end 66 of motor protector 24. Although the elongate frame members may not extend from top end 68 to bottom end 66, it may be desired that frame 72 extend at least axially farther than the expanded axial length of compensator 50 to eliminate ledges and the like for compensator 60 (e.g., diaphragms, etc.) to stick on and/or from which sand particles 33 may bridge and prevent free movement of compensator 50. Frame 72 may be constructed in various manners, for example and without limitation, to an elongated tubular member constructed of a metal or other suitable material for the anticipated well conditions.

In the depicted embodiment, frame 72 provides channels 74 to facilitate expelling sand particles 33 from the bellows portion of frame 72. For example, in the depicted embodiment, elongated members 72*a* are spaced apart so as to define channels 74 between adjacent members 72*a*. If frame 72 is constructed of a tubular member for example, channels 74 may comprise holes, slots or other voids through which sand particles 33 may be expelled. In the embodiment depicted in FIGS. 2 and 3, the elongate member frame 72 is utilized to space compensator 50 (e.g., center) from compensator housing 52 and to provide a controlled annular space 70 between compensator 50 and compensator housing 52. Controlled annular space 70 may be provided by sizing and positioning frame 72 so that the selected controlled space 70 is defined between housing 52 and frame 72. Similar to ports 64, channels 74 may be sized to avoid bridging of the particle size distribution of solids 33.

Figure 4:
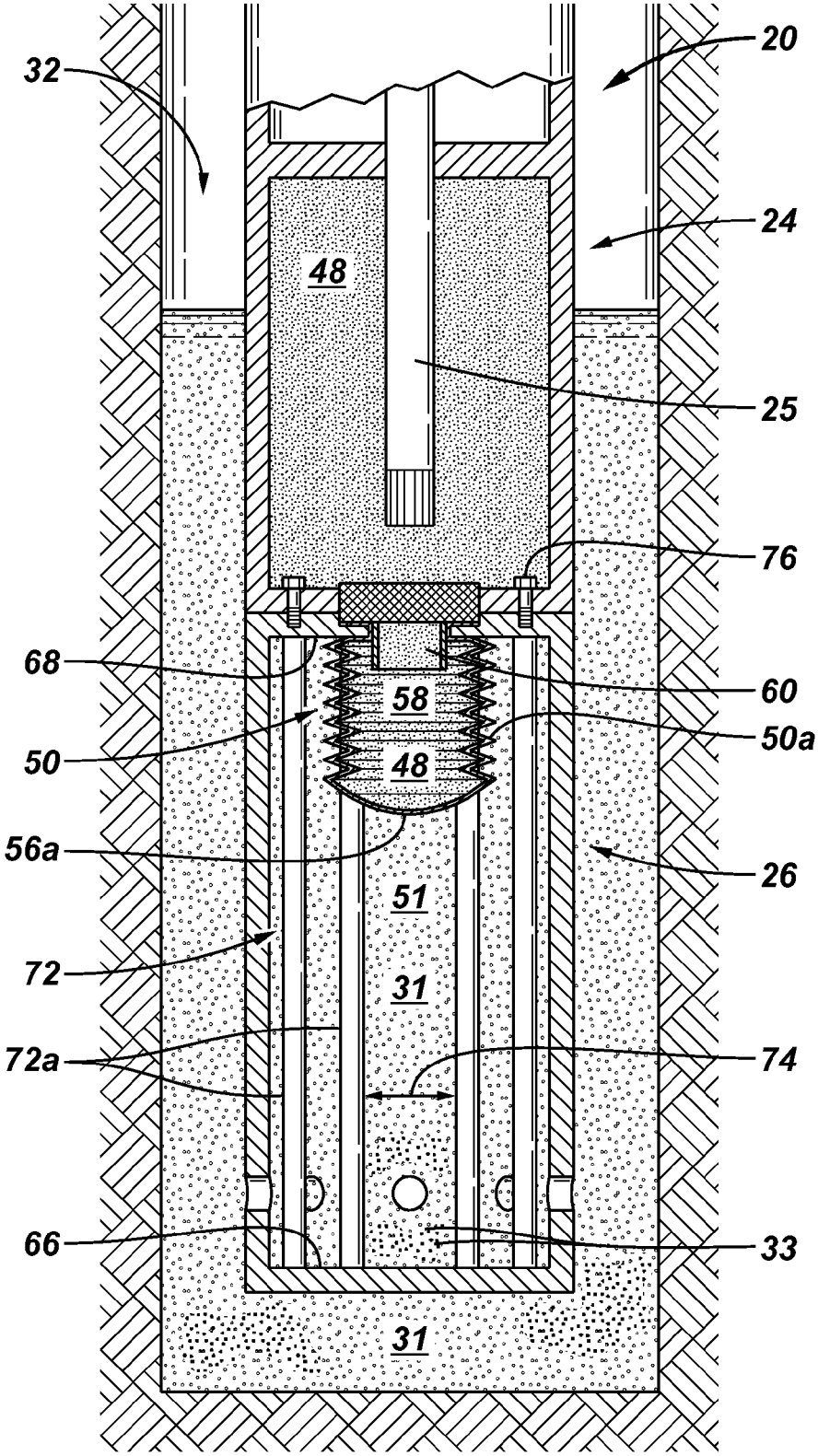
FIG. 4 is an expanded, schematic cut-away view of another embodiment of motor protector according to one or more aspects of the present disclosure.

FIG. 4 is an expanded, sectional schematic of another embodiment of a motor protector and compensator according to one or more aspects of the present disclosure. In this embodiment, compensator housing 52 (e.g., a tubular member) depicted in FIGS. 2 and 3 is eliminated and frame 72 is utilized. In the depicted embodiment, frame 72 comprises a plurality of axially extending, spaced apart elongate members 72*a*. Frame 72 defines a substantially cylindrical (e.g., tubular) compensator chamber 51 in which bellows 50 is disposed.

Elongate members 72*a* are constructed of metal rods in the depicted embodiment and extend between a top member 68 and bottom member 66. Bottom member 66 may be a solid metal member and/or a member comprising holes or spaces. Top member 68 is flange member adapted to be attached to another module, or section, of pump system 20 such as pump 24 in the depicted embodiment. Top member 68 may be attached in various manners including without limitation, welding, threading and bolting. Top member 68 is illustrated in FIG. 4 attached to pump 24 via bolts 76.

Similar to the embodiments depicted in described with reference to FIGS. 2 and 3, compensator 50 comprises a bellows. Motor fluid 48 is in fluid communication with the interior 58 of compensator 50 via opening 60. Well fluid 31 is in fluidic communication with the exterior 50*a* via channels 74 formed through frame 72. As described above, channels 74 may be sized to avoid or limit bridging of solids 33.

Figure 5:
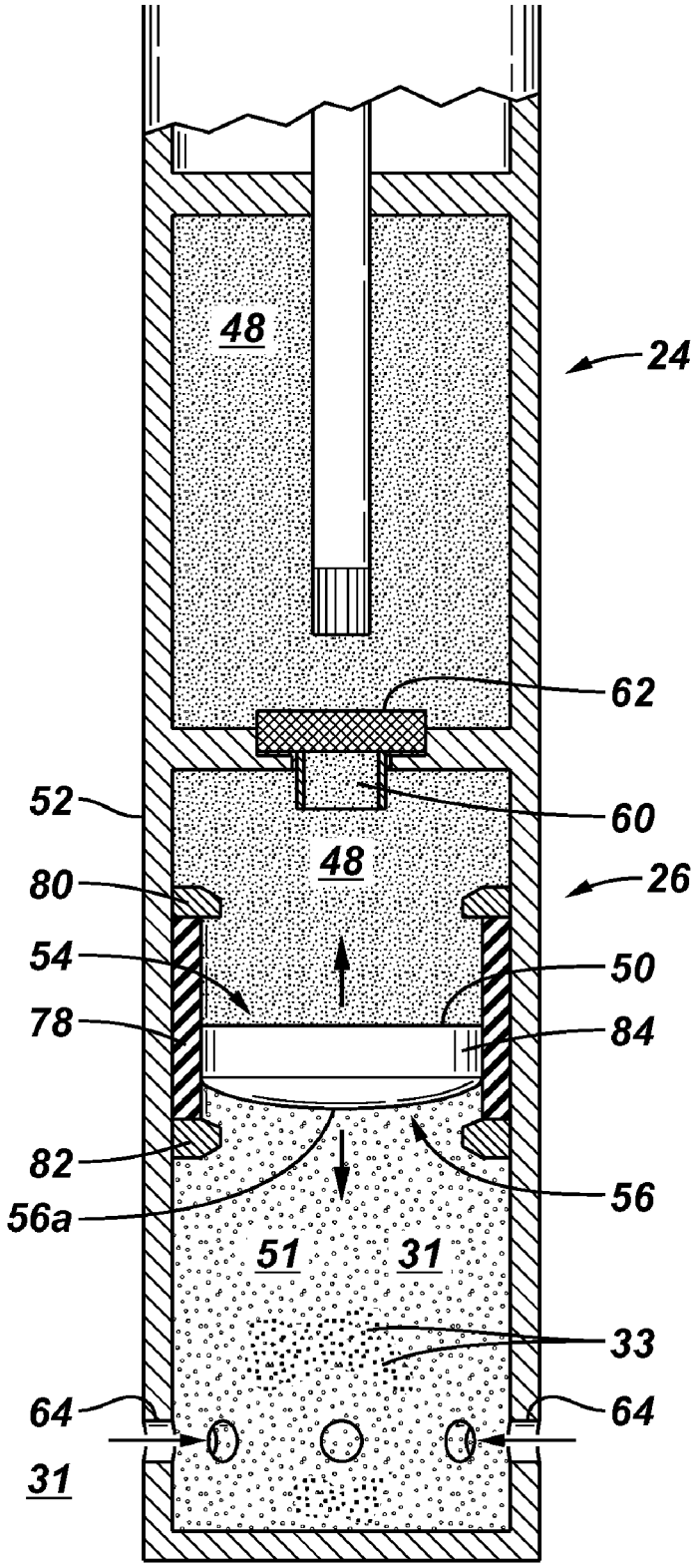
FIG. 5 is an expanded, schematic cut-away view of another embodiment of motor protector according to one or more aspects of the present disclosure.

FIG. 5 is an expanded schematic view of another embodiment of a motor protector according to one or more aspects of the present disclosure. Motor protector 26 is depicted positioned below motor 24. Motor fluid 48 is in fluid communication with housing 52 through for example opening 60. Well fluid 31 is in fluid communication with compensator chamber 51 through one or more ports 64 formed through compensator housing 52. In the embodiment depicted in FIG. 5, motor fluid 48 and well fluid 31 are separated in compensator housing 52 and chamber 51 via a compensator 50. In this embodiment, compensator 50 is a plunger. Plunger 50 is a generally cylindrical member having an outer perimeter 80.

Plunger 50 comprises a motor fluid end 54 and a well fluid end 56. Well fluid end 56 of depicted plunger 50 is contoured (e.g., domed) for example to promote moving solids 33 ahead of compensator 50 and expelling solids 33 out of chamber 51 through ports 64. In the depicted embodiment, plunger 50 is axially moveable along (e.g., through) a stationary seal 78 which is depicted disposed on the interior of compensator housing 52 in response to the expansion and contraction of motor fluid 48. Stationary seal 78 may extend axially between top and bottom axial plunger stops 80, 82.

Stationary seal 78 effects the seal on the outer perimeter 84 of plunger 50 as opposed to the seal being effected on a cylinder wall as with pistons. In some embodiments, perimeter 80 may be may be coated or treated to form a low friction surface. An example of a suitable surface treatment is a polytetrafluoroethylene (PTFE)-filled electroless nickel plating or chrome plating. Seal 78 may be formed of an elastomeric and/or polymer material.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A motor protector comprising:

a housing defining a filterless compensator chamber for admitting a well fluid containing particulates;

a compensator disposed in the filterless compensator chamber having a motor fluid end in fluid communication with a motor fluid and a well fluid end, the compensator axially moveable relative to the housing in response to the expansion and contraction of the motor fluid;

a port formed through the housing to provide fluid communication with the well fluid containing particulates from an exterior of the housing to the well fluid end of the compensator; and rods axially disposed around the compensator in the filterless compensator chamber to guide the compensator from interfering with particulates accumulated in the filterless compensator chamber.

2. The motor protector of claim 1, wherein the rods define a size of an annular space around the compensator in which the particulates accumulate.

3. The motor protector of claim 1, wherein the compensator comprises one selected from the group of a bellows and a plunger.

4. The motor protector of claim 1, wherein the well fluid end of the compensator comprises a contoured feature having an apex.

5. The motor protector of claim 4, wherein the compensator comprises one selected from the group of a bellows and a plunger.

6. The motor protector of claim 1, wherein:

the compensator comprises a bellows having an interior in fluid communication with the motor fluid and an exterior perimeter; and a distance between a largest circumference of the bellows and the housing, the distance comprising an enforced annular space, is twice the diameter of the port.

7. The motor protector of claim 6, wherein the rods further comprise a frame positioned in the compensator chamber between the exterior perimeter of the bellows and the housing.

8. The motor protector of claim 7, further comprising a channel formed between each pair of the rods.

9. The motor protector of claim 8, wherein each channel comprises a diameter at least equal to the diameter of the port, for passage of the particulates.

10. The motor protector of claim 1, wherein:

the compensator comprises a bellows having an interior in fluid communication with the motor fluid and an exterior perimeter; and further comprising:

a frame positioned between the exterior perimeter and the housing, the frame extending axially at least the distance of the axially expanded compensator.

11. A submersible pump system, the system comprising:

a pump disposed in a wellbore containing a wellbore fluid and particulates;

a motor disposed in the wellbore, the motor comprising a motor fluid; and a motor protector disposed in the wellbore, the motor protector comprising:

a housing defining a filterless compensator chamber;

a port formed radially through the housing;

a bellows disposed in the filterless compensator chamber, the bellows comprising an interior in fluid communication with the motor fluid and a well fluid end in fluid communication with the wellbore fluid and particulates via the port, the bellows axially expandable relative to the housing in response to the expansion and contraction of the motor fluid; and rods axially disposed around the bellows in the filterless compensator chamber to guide the bellows from interfering with particulates accumulated in the filterless compensator chamber.

12. The system of claim 11, wherein a channel intervenes between each pair of adjacent rods, each channel comprising a diameter at least as large as the diameter of the port.

13. The system of claim 11, wherein the well fluid end of the bellows comprises a contoured feature having an apex.

* * * * *